United States Patent [19]

Hillberg

[11] 4,208,947

[45] Jun. 24, 1980

[54] FIREARM HAMMER BLOCKING SAFETY MECHANISM

[75] Inventor: Robert L. Hillberg, Chesire, Conn.

[73] Assignee: Wildey Firearms Company, Inc., Cold Spring, N.Y.

[21] Appl. No.: 941,271

[22] Filed: Sep. 11, 1978

[51] Int. Cl.[2] ..... F41C 17/08

[52] U.S. Cl. ..... 89/148; 42/70 F

[58] Field of Search ..... 42/70 F; 89/142, 147, 89/148

[56] References Cited

U.S. PATENT DOCUMENTS 2,846,925 8/1958 Norman ..... 89/148

*Primary Examiner*—Stephen C. Bentley

*Attorney, Agent, or Firm*—McCormick, Paulding & Huber

[57] ABSTRACT

A safety mechanism for a firearm includes a hammer block engageable with the hammer to prevent the hammer from moving into engagement with the firing pin. The hammer block is manually shifted between its active and inactive positions through a safety cam having a positive driving connection with the block. As the cam is moved to shift the block from its non-blocking to its blocking position, the cam also engages the sear to release the sear from the trigger and to allow the hammer to move from its cocked position into a safety position in engagement with the hammer block. A compact arrangement is obtained by having the safety cam non-rotatably carried by an operating shaft which also serves as the pivot pin for the hammer and by having the hammer spring received in a hammer recess in surrounding relation to the safety cam operating shaft. The hammer block and sear are also mounted on a single pivot pin common to the two parts.

8 Claims, 11 Drawing Figures

FIREARM HAMMER BLOCKING SAFETY MECHANISM

BACKGROUND OF THE INVENTION

This invention relates to firearms of the type having spring biased pivotal hammers for actuating their firing pins, and deals more particularly with a safety mechanism for such a firearm which safety mechanism includes a hammer block movable into engagement with the hammer to prevent the hammer from moving into firing engagement with the firing pin.

By way of example, the safety mechanism of this invention is herein shown and described in connection with a gas operated pistol such as shown in U.S. Pat. No. 3,988,964. The mechanism is particularly well adapted to such a firearm since it requires relatively few parts and since parts as are involved are arranged in relatively compact form. However, it should be understood that the invention is not limited to the particular firearm shown and described but may instead be used with many other types of firearms having pivotal hammers.

The general object of this invention is to provide a safety mechanism for a pivotal hammer firearm which safety mechanism is comprised of relatively few parts, is compact in form, is easy to assemble and disassemble, is easy to operate and which has a positive reliable mechanical action which assures that the safety function is achieved so long as the thumbpiece of the safety lever is in the "safe" position.

Other objects of the invention will be apparent from the following description and from the drawings forming a part hereof.

SUMMARY OF THE INVENTION

The invention resides in a safety mechanism for a firearm which mechanism includes a spring biased pivotal hammer having a sear notch surface engageable with a spring biased sear to hold the hammer in a cocked position. The hammer also includes a safety notch surface which cooperates with a pivotally movable hammer block. The hammer block is positively moved between active and inactive positions relative to the hammer safety notch surface by a safety cam. This safety cam also includes a means which engages the sear and moves the sear out of engagement with the hammer as the hammer block is shifted to its blocking position, thereby freeing the hammer from the sear and allowing it to drop onto the hammer block which thereafter holds it in a safe position spaced from the firing pin.

The invention also resides in the fact that the sear and hammer block are mounted on a single common pivot pin and in the fact that the operating shaft for the safety cam serves as the pivot pin for the hammer, the hammer having a recess and being biased by a helical torsion spring having its wound portion located in the hammer recess in surrounding relation to the safety cam operating shaft.

DETAILED DESCRIPTION OF THE PREFERRED EMBODIMENT

Figure 1:
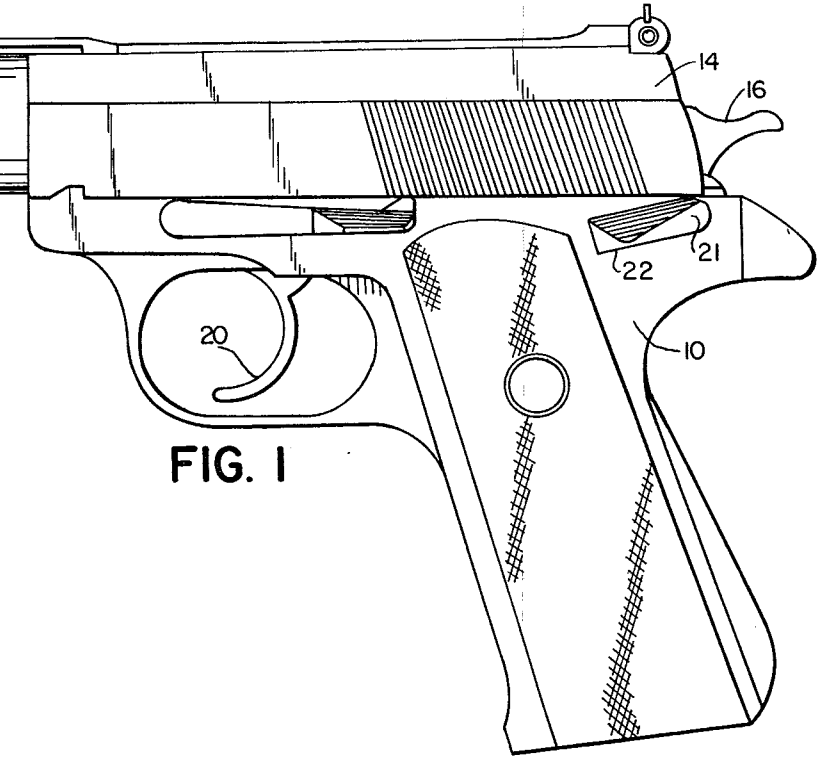
FIG. 1 is an elevational view of a firearm having a safety mechanism embodying the present invention.

Turning to the drawings and first referring to FIG. 1, this figure shows a gas operated pistol having a hammer safety mechanism embodying the present invention and having a frame 10, barrel 12, slide 14, hammer 16, gas adjuster 18, trigger 20, and safety lever 21. The slide 14 is shown in its normal forward position. From this position it is movable rearwardly, either by hand or by the gas generated during the firing of a cartridge, to operate a bolt carrying a firing pin and extractor. The adjuster is movable angularly relative to the barrel to vary the effectiveness of the gas in moving the slide. As the slide is moved rearwardly during the firing of a cartridge, the bolt is unlocked and moved rearwardly, the hammer 16 is cocked and the spent cartridge shell is extracted; and as the slide returns under the force of biasing springs to its illustrated normal position, a new cartridge is moved into the firing chamber, and the bolt is returned to its locked firing position so that the pistol is ready for firing by pulling the trigger 20, the foregoing thereby providing the pistol with a semi-automatic operation.

In FIG. 1, the hammer 16 is shown in a down position. From this position it can be moved to a cocked position by thumb pressure applied to its spur for subsequent firing in a single action manner. With the hammer in the down position the firearm can also be fired, in a double action manner, by simply pulling on the trigger 20.

Figure 2:
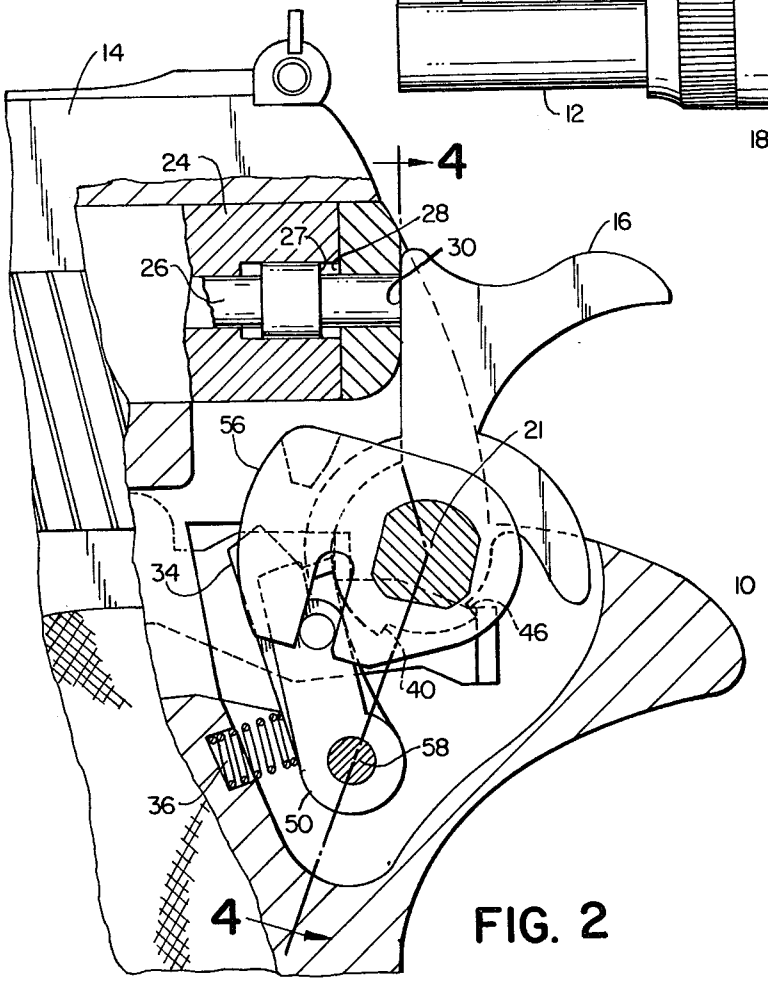
FIG. 2 is an enlarged fragmentary view of the rear portion of the firearm of FIG. 1 with some parts being shown broken away to reveal the structure of the safety mechanism.
Figure 3:
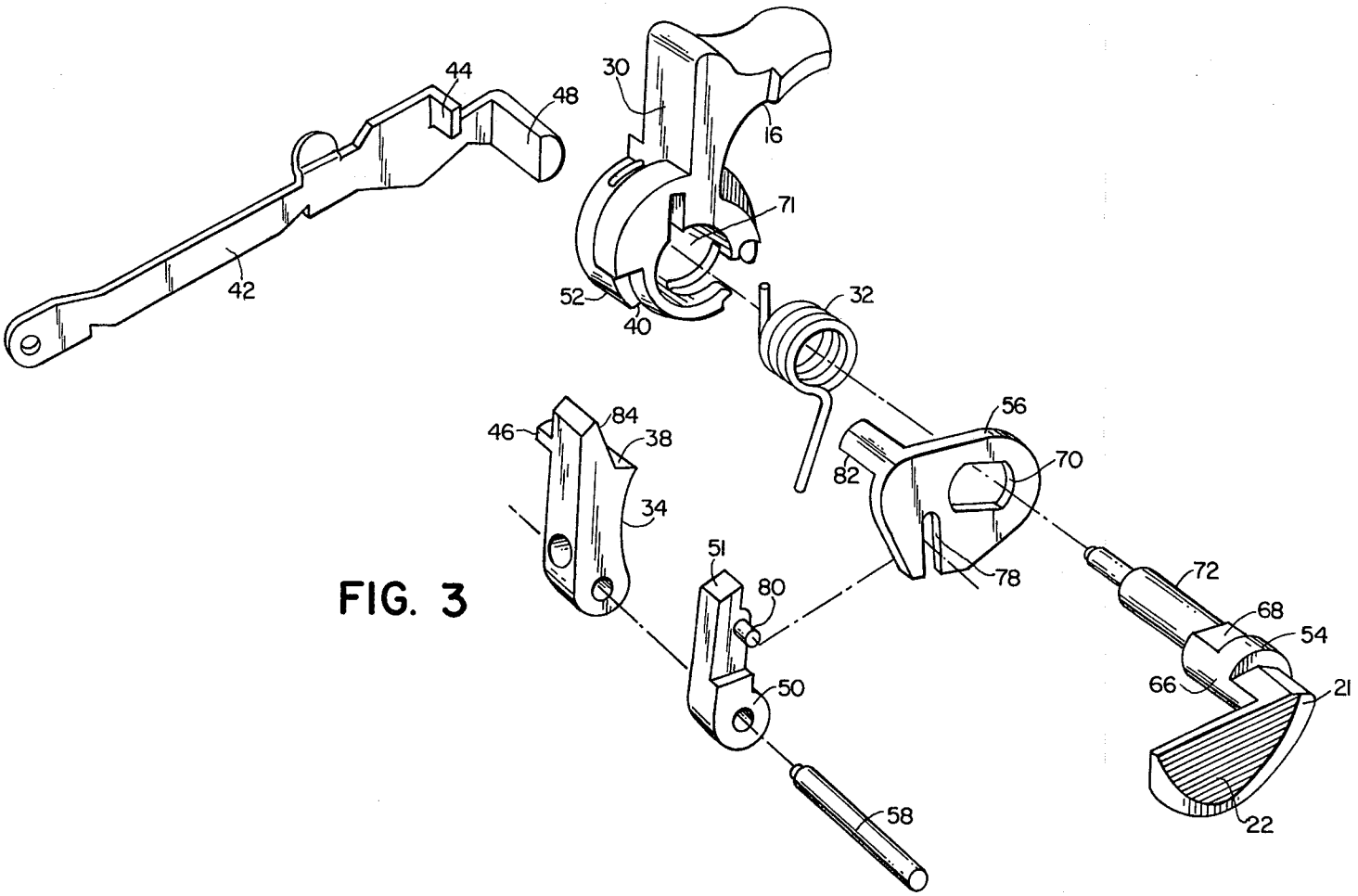
FIG. 3 is an exploded view of the safety mechanism of FIG. 2.

Referring to FIG. 2, the bolt of the firearm is indicated at 24 and carries an inertial firing pin 26. The firing pin is urged rearwardly by a spring (not shown) in the bolt toward a rearwardly limited normal position defined by engagement of the firing pin shoulder 27 with the bolt shoulder 28. The hammer 16 has a striking face 30, and when the hammer is in its illustrated down position the striking face 30 engages the rear end of the firing pin 26 and the rear end of the bolt 24 and holds the firing pin in the illustrated position at which the firing pin is shifted somewhat from its normal rearwardly limited position but with the forward end of the firing pin still being out of firing contact with the cartridge in the firing chamber. Of course, during firing movement of the hammer 16, the striking face thereof hits the rear end of the firing pin with sufficient impact to drive the pin inertially forwardly of the illustrated position of FIG. 2 to fire a cartridge.

As shown in FIGS. 2 to 5, the hammer is pivotally connected to the frame 10 for movement about an axis extending transversely of the frame and is biased by a hammer spring 32. A sear 34 is supported for pivotal movement relative to the body and is urged toward the hammer by a sear spring 36. An abutment surface 38 on the sear is engageable with a sear notch surface 40 on the trigger to hold the trigger in its cocked position. A trigger bar 42, which is connected to the trigger and which moves forwardly when the trigger is pulled, has a finger 44 engageable with a tab 46 on the sear to release the sear from the hammer and to thereby allow the hammer to drop, under the action of the hammer spring 32, from its cocked toward its down or firing position. The hammer also has a double action notch surface 46 which cooperates with another finger 48 on the trigger bar. That is, when the hammer is in the down position the trigger bar finger 48, upon forward movement of the trigger bar caused by pulling of the trigger, engages the double action notch surface 46 to rotate the hammer clockwise, as seen in FIG. 2, and after a certain amount of such clockwise hammer movement, the finger 48 falls from the notch surface 46 thereby releasing the hammer for firing movement in the counterclockwise direction.

In accordance with the invention, a safety mechanism is provided in the pistol for positively blocking the hammer, when the safety lever is set to its "safe" position, against movement into contact with the firing pin and to prevent the sear from engaging and holding the hammer in its cocked position. The parts of this safety mechanism include a hammer block 50 having an abutment surface 51 cooperable with a safety notch surface 52 on the hammer. It also includes the safety lever 21 and a safety cam 56.

Figure 4:
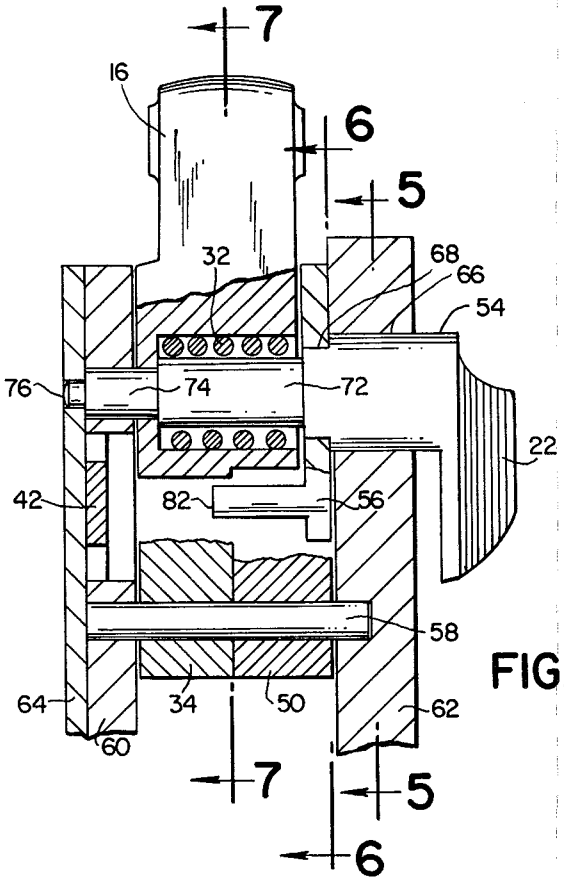
FIG. 4 is a transverse sectional view taken generally on the line 4—4 of FIG. 2.
Figure 5:
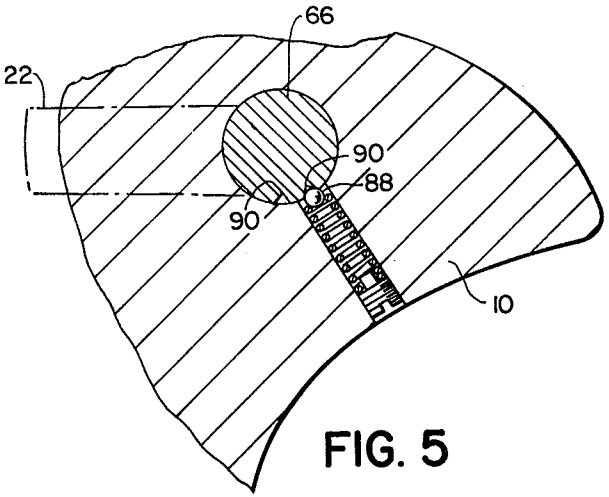
FIG. 5 is a fragmentary sectional view taken on the line 5—5 of FIG. 4.

Preferably, and as shown, the sear 34 and hammer block 50 are mounted on a common transverse pivot pin 58 which extends between two walls 60 and 62 of the frame, as shown in FIG. 4, the wall 60 having a cover plate 64 which retains the pin 58 in place. The safety lever 21 in addition to carrying the safety cam 56 also preferably serves to pivotally support the hammer 16. For this purpose, the lever 21, in addition to a thumbpiece 22 includes a shaft 54 divided into a number of portions along its length. One portion 66 is journaled in the frame wall 62 and an adjacent portion 68 is noncircularly shaped and receives the safety cam 56 through a similarly shaped noncircular opening 70 in the cam, the cam therefore being nonrotatably fixed to the safety lever. Another portion 72 receives the helically wound part of the hammer spring 32, another portion 74 both rotatably supports the hammer 16 and is journaled in the other frame wall 60, and a final portion 76 is received in a conforming opening in the cover plate 64. The hammer is recessed, as indicated at 71, to receive the hammer spring 32.

The safety cam 56 includes a notch 78 which receives a pin 80 of the hammer block 50 to provide a positive driving connection between those two parts. Also included on the safety cam is an arm 82 which is cooperable with a cam surface 84 on the sear 34 as hereinafter described in more detail. The safety lever 21 is movable between "safe" and "non-safe" positions by the thumbpiece 22 and it is releasably held in said two positions by a detent mechanism, shown in FIG. 5, consisting of a spring biased ball 88 receivable in either one of two depressions 90, 90 in the shaft portion 66 of the safety lever, this detent also serving to restrain the safety lever against movement relative to the frame.

Figure 7:
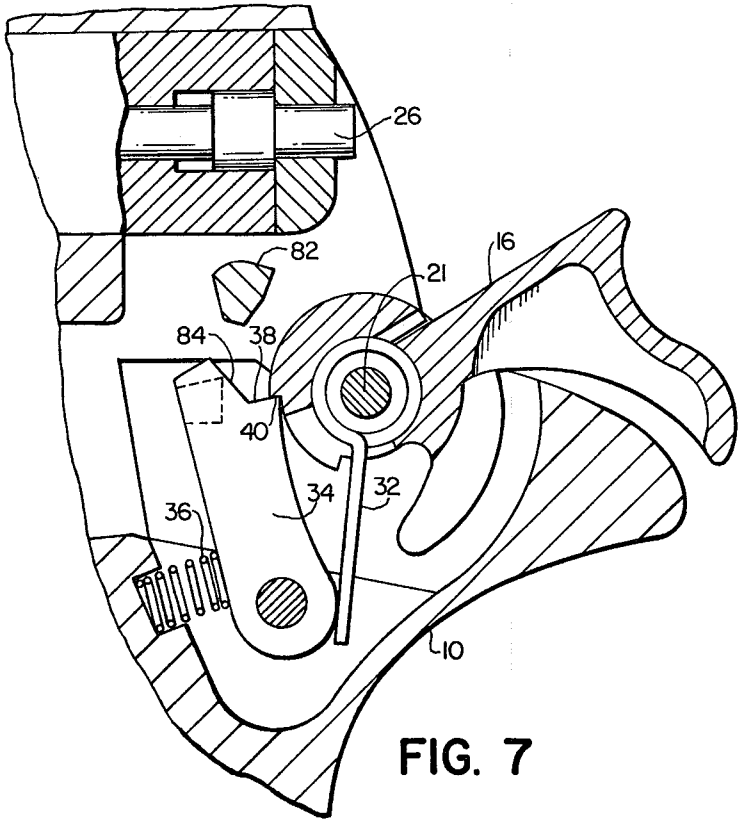
FIGS. 6 and 7 are views taken respectively on the lines 6—6 and 7—7 of FIG. 4, and show the parts of the safety mechanism with the hammer in its cocked position and the safety cam in its "non-safe" position.
Figure 6:
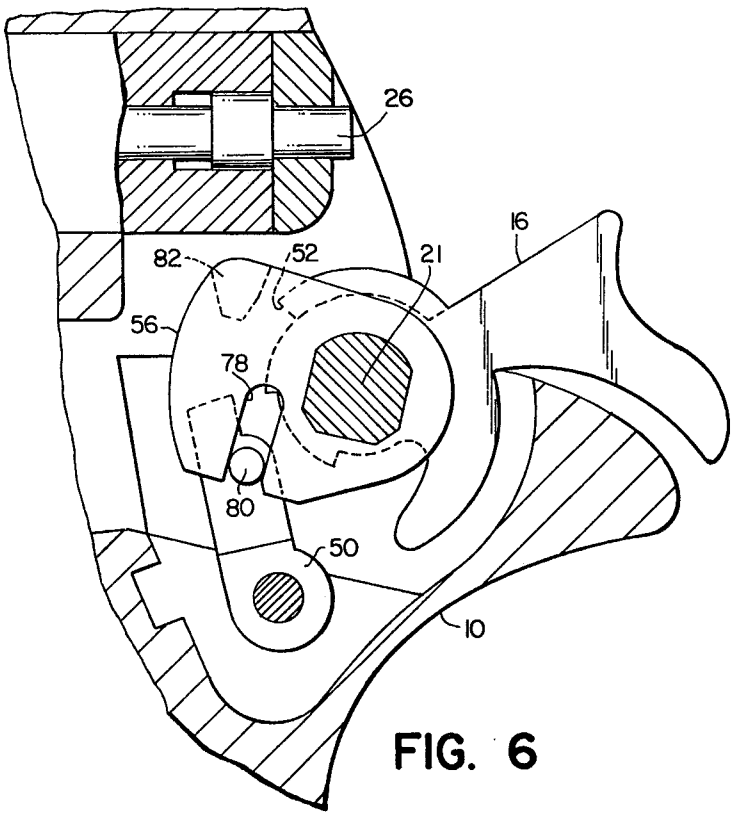

Having now described the construction of the safety mechanism, its operation may be considered with reference to FIGS. 6 to 11. FIGS. 6 and 7 show the hammer 16 in its cocked position at which it is held by engagement of the sear abutment surface 38 with the sear notch surface of the hammer. In FIGS. 6 and 7 the safety lever 21 is shown positioned in its "safe" position, and in this position of the lever the safety cam 56, through its notch 78 and the pin 80 on the hammer block 50 hold the block 50 in a non-blocking position relative to the safety abutment 52 on the hammer. Therefore, if the sear 34 is now pulled from its engaged position with the hammer 16 the hammer will be released of firing movement into contact with the firing pin 26.

Figure 9:
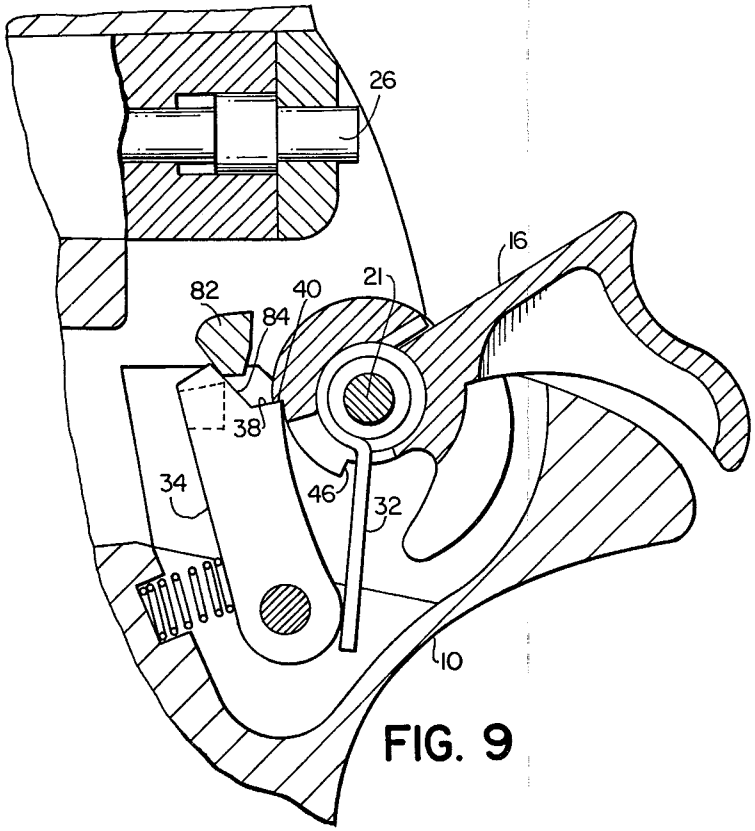
FIGS. 8 and 9 are similar to FIGS. 6 and 7, respectively, but show the parts of the safety mechanism in the positions occupied as the safety cam is moved from the FIG. 6 position to almost its "safe" position.
Figure 8:
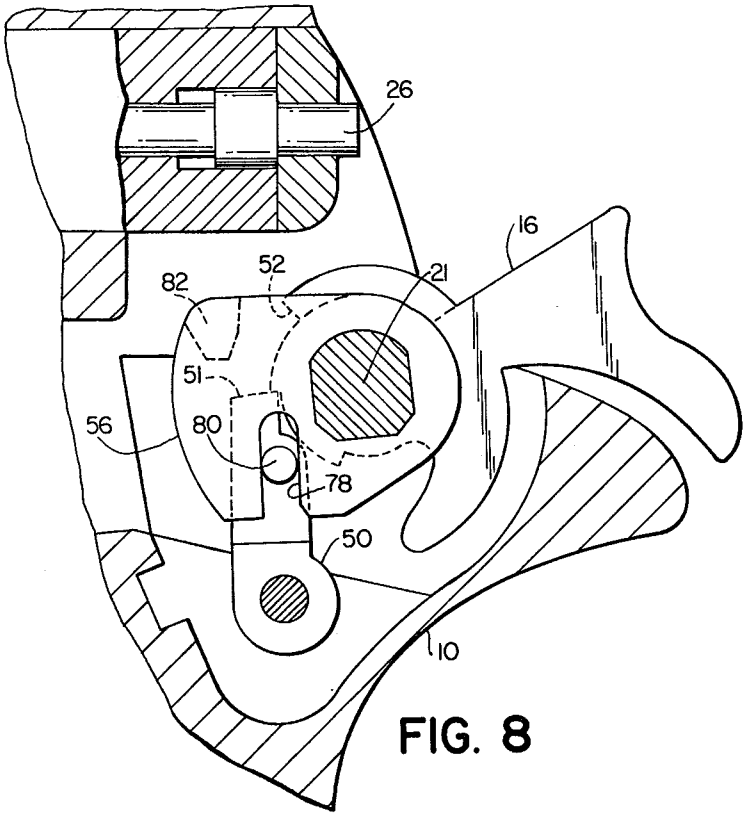

FIGS. 8 and 9 are similar to FIGS. 6 and 7 except that the safety lever 21 has now been moved toward its safe position until the arm 82 on the safety cam engages the cam surface 84 on the sear 34. At this point, the sear 34 is still in holding relation relative to the hammer 16, but through the action of the notch 78 of the safety cam and the pin 80 of the safety block the safety block 50 has been moved into blocking relationship relative to the hammer safety abutment surface 52. Therefore, if the sear 34 were now released from the hammer, the hammer would drop into engagement with the hammer block.

Figure 11:
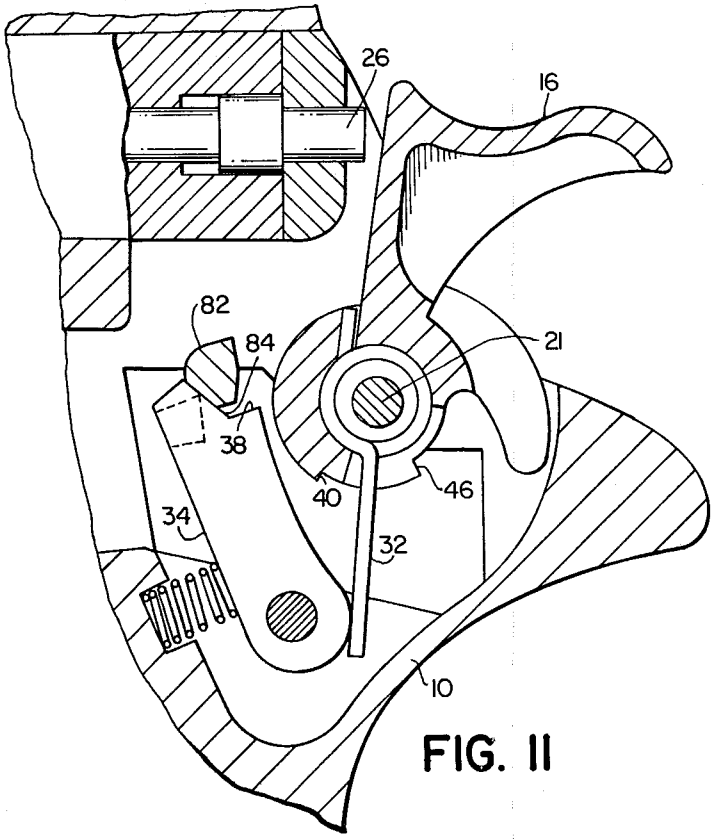
FIGS. 10 and 11 are similar to FIGS. 8 and 9, respectively, but show the parts of the safety mechanism in the positions occupied after the safety cam is moved from the FIG. 8 position completely to its "safe" position.
Figure 10:
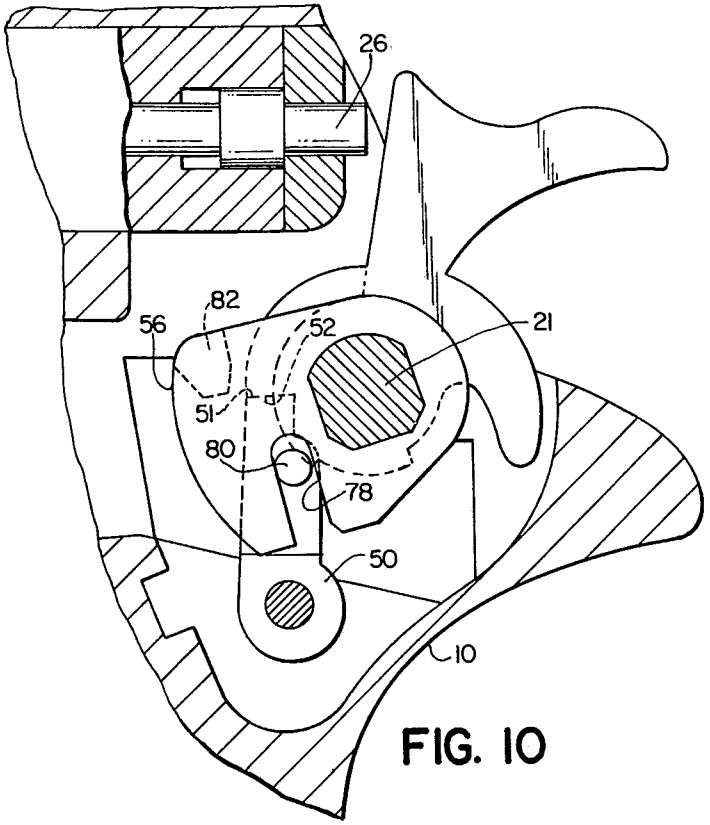

FIGS. 10 and 11 show the positions of the parts after the safety lever 21 and safety cam 56 have been moved fully to their "safe" position reached by moving counterclockwise a slight distance from their positions as illustrated in FIGS. 8 and 9. During this movement, the arm 82 on the safety cam, through engagement with the cam surface 84 on the sear, moves the sear abutment surface 38 out of engagement with the sear notch surface 40 on the hammer thereby allowing the hammer to move counterclockwise from its still cocked position of FIGS. 8 and 9. Such counterclockwise movement of the hammer is, however, arrested by the safety notch 52 of the hammer moving into engagement with the abutment surface 51 of the hammer block, such engagement limiting the counterclockwise movement of the hammer to the position shown in these FIGS. 10 and 11 at which it is spaced a short distance rearwardly from the rear end of the firing pin 26.

I claim:

1. In a firearm, the combination comprising: a frame, a firing pin slidable for and aft relative said frame and having a rear end, means biasing said firing pin rearwardly toward a rearwardly limited normal position, a hammer having a striking face, means connecting said hammer to said frame for pivotal movement of said hammer relative to said frame between a down position at which said striking face engages the rear end of said firing pin and shifts said firing pin forwardly of said normal position and other positions including a safety position and a cocked position reached by pivoting said hammer rearwardly from said down position, said striking face of said hammer being spaced from said rear end of said firing pin when said hammer is in said safety position and said striking face of said hammer being spaced still further from said rear end of said firing pin when said hammer is in said cocked position, a hammer spring working between said hammer and said frame urging said hammer toward said down position, said hammer having a sear notch surface and a safety notch surface, a sear having an abutment surface, means pivotally connecting said sear to said frame for movement between an engaged position at which its said abutment surface engages said sear notch surface of said hammer to hold said hammer in said cocked position and a released position at which its said sear abutment surface is removed from said sear notch surface of said hammer, a hammer block having an abutment surface, means pivotally connecting said hammer block to said frame for movement between a blocking position at which said block abutment surface is engageable with said safety notch surface of said hammer to hold said hammer in said safety position and a non-blocking position at which said block abutment surface is removed from the path of said safety notch surface of said hammer, means urging said sear toward its engaged position, a manually operable safety cam pivotally connected to said frame for movement between "safe" and "non-safe" positions, and means mechanically connecting said safety cam to said hammer block for positively moving said hammer block between its blocking and non-blocking positions in response to movement of said safety cam between its "safe" and "non-safe" positions respectively, said safety cam also including means engageable with said sear to shift said sear from its engaged to its released position as said safety cam is moved from its "non-safe" to its "safe" position.

2. In a firearm, the combination defined in claim 1 further characterized by a safety lever having a thumbpiece located externally of said frame and also having an operating shaft pivotally received by said frame and extending transversely thereof, said safety cam being nonrotatably fixed to said operating shaft of said safety lever.

3. In a firearm, the combination defined in claim 2 further characterized by said hammer being pivotally mounted on said operating shaft of said safety lever.

4. In a firearm, the combination defined in claim 3 further characterized by said hammer spring including a helically coiled torsion spring portion, said helically coiled torsion spring portion of said spring being received on said operating shaft of said safety lever.

5. In a firearm, the combination defined in claim 4 further characterized by said hammer having a recess surrounding said operating shaft portion of said safety lever which recess receives said helically coiled torsion spring portion of said hammer spring.

6. In a firearm, the combination clarified in claim 1 further characterized by said means pivotally connecting said sear to said frame and said means pivotally connecting said hammer block to said frame including a single transverse pivot pin carried by said frame on which both said sear and said hammer block are loosely mounted.

7. In a firearm, the combination comprising: a frame, a safety lever having a thumbpiece located externally of said frame and an operating shaft portion extending transversely relative to said frame and supported by said frame for pivotal movement relative thereto between "safe" and "non-safe" positions, a hammer loosely supported on said shaft portion of said safety lever for pivotal movement relative to said frame, said hammer having a sear notch surface and a safety notch surface, a safety cam non-rotatably fixed to said shaft portion of said safety lever, a sear having an abutment surface, means pivotally connecting said sear to said frame for movement between an engaged position at which its abutment surface engages said sear notch surface of said hammer to hold said hammer in a cocked position and a released position in which its sear abutment surface is removed from said sear notch surface of said hammer, a hammer block having an abutment surface, means pivotally connecting said hammer block to said frame for movement between a blocking position at which said block abutment surface is engageable with said safety notch surface of said hammer to hold said hammer in a safety position and a non-blocking position at which said block abutment surface is removed from the path of said safety notch surface of said hammer, means urging said sear toward its engaged position, and means mechanically connecting said safety cam to said hammer block for positively moving said hammer block between its blocking and non-blocking positions in response to movement of said safety lever between its "safe" and "non-safe" positions respectively, said safety cam also including means engageable with said sear to shift said sear from its engaged to its released position as said safety lever is moved from its "non-safe" to its "safe" position.

8. In a firearm, the combination defined in claim 7 further characterized by said means pivotally connecting said sear to said frame and said means pivotally connecting said hammer block to said frame comprising a single pivot pin on which both said sear and said hammer block are loosely mounted.

* * * * *